US006527677B2

(12) United States Patent
Maresh

(10) Patent No.: US 6,527,677 B2
(45) **Date of Patent: *Mar. 4, 2003**

(54) ELLIPTICAL MOTION EXERCISE MACHINE

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

This patent is subject to a terminal disclaimer.

(21) Appl. No.: 09/766,781

(22) Filed: Jan. 22, 2001

(65) Prior Publication Data

US 2001/0031685 A1 Oct. 18, 2001

Related U.S. Application Data

(63) Continuation of application No. 09/593,971, filed on Jun. 13, 2000, which is a continuation of application No. 09/030,133, filed on Feb. 25, 1998, now Pat. No. 6,083,143, which is a continuation of application No. 08/535,566, filed on Sep. 28, 1995, now Pat. No. 5,725,457.

(51) Int. Cl.[7] ..... A63B 22/00
(52) U.S. Cl. ..... 482/51; 482/57
(58) Field of Search ..... 482/51–53, 57, 482/70, 79–80

(56) References Cited

U.S. PATENT DOCUMENTS

| | | | | |
|---|---|---|---|---|
| 4,185,622 A | 1/1980 | Swenson | 128/25 B |
| 5,195,935 A | 3/1993 | Fencel | 482/70 |
| 5,279,529 A | 1/1994 | Eschenbach | 482/57 |
| 5,299,993 A | 4/1994 | Habing | 482/52 |
| 5,372,563 A | 12/1994 | Chien-Nan | 482/79 |
| 5,383,829 A | 1/1995 | Miller | 482/57 |
| 5,573,480 A | 11/1996 | Rodgers | 482/57 |
| 5,707,321 A | 1/1998 | Maresh | 482/57 |
| 5,725,457 A | 3/1998 | Maresh | 482/57 |
| 6,083,143 A | 7/2000 | Maresh | 482/57 |

*Primary Examiner*—S R Crow

(57) ABSTRACT

A multiple rigid bar mechanism serving as an exercise machine which may be characterized as providing a motion path along a closed curve. In the simplest embodiment, the mechanism comprises a motion bar rotatably connected to a flywheel and a trunnion element. The flywheel is rotatably secured to the machine frame about a flywheel base joint, and is eccentrically connected to the motion bar at a flywheel motion bar first joint. Upon input force from the machine operator at a motion bar force input region, the motion bar will be caused to pivot about a motion bar trunnion region thus effecting the motion bar first joint to translate at an eccentric radius about the flywheel or crank rotational axis. The mechanism may be used to exercise the operators upper and/or lower body, and may be described as having a reciprocating type of resistive motion with inertial characteristics of a flywheel.

20 Claims, 8 Drawing Sheets

ELLIPTICAL MOTION EXERCISE MACHINE

CROSS-REFERENCE TO RELATED APPLICATIONS

This is a continuation of U.S. patent application Ser. No. 09/593,971, filed on Jun. 13, 2000, which in turn, is a continuation of U.S. patent application Ser. No. 09/030,133, filed on Feb. 25, 1998 (now U.S. Pat. No. 6,083,143), which in turn, is a continuation of U.S. patent application Ser. No. 08/535,566, filed on Sep. 28, 1995 (now U.S. Pat. No. 5,725,457).

BACKGROUND OF THE INVENTION

The prior art is replete with exercise machines and devices which provide motion resistance to various muscle groups of the human body. These devices vary significantly in force and motion characteristics and are designed to interface with the operator to target specific muscle groups. The general categories of prior art exercise machines or mechanisms include cycles, treadmills, stepping, skiing and rowing machines.

The present invention is a novel mechanism which may be utilized to exercise the upper and/or lower body, and may be described as having a continuous reciprocating type of resistive motion with momentum characteristics of a connected flywheel.

BRIEF DESCRIPTION OF THE INVENTION

This mechanism is designed to interact with a seated operator. The invention consists of several members which cooperate together to produce an output with force and motion path characteristics which interface with the operator in a new and novel manner. In the simplest embodiment, these members comprise hand or foot motion bar receiving elements connected to a motion bar, where the motion bar is rotatably connected to a flywheel and is caused to pivot at a motion bar trunnion region.

The flywheel is rotatably secured to the machine frame about a flywheel base joint, and is eccentrically connected to the motion bar at a flywheel motion bar first joint. The centerline distance between the two flywheel joints will be referred to in this text as the flywheel eccentric radius. Different force characteristics may be achieved dependent upon whether the flywheel concentrically rotates about an axis fixed to the machine frame, concentrically rotates about the motion bar first joint, or eccentrically rotates about both of the flywheel joints. In the latter case, if the flywheel centroid is purposely located a considerable distance at a particular orientation from either flywheel joint, the momentum characteristics transferred to the motion bar may be timed to be in synch with the maximum efficiency or ability of the operator to react to them, albeit subjecting the machine to additional imbalance and vibration.

The purpose of the trunnion region is to constrain a region of the motion bar trunnion region such that as the motion bar first joint circumferentially travels about the flywheel base joint, the trunnion region is permitted to travel back and forth in a first general direction and not allowed to translate in a generally perpendicular direction. The effect of constraining the trunnion region in one general direction results in a motion path, at the end of the motion bar opposite the motion bar first joint, to travel about a closed curve with a minor axis of a length approximate to twice the length of the eccentric flywheel radius, and a major axis which may be calculated by an equation beyond the scope of this specification.

The motion bar interface region is that portion of the motion bar which directly or indirectly interfaces with the machine operator. During direct interface, the operators feet or hands will cyclically actuate the motion bar during the exercise session, and during indirect operator interface region of the motion bar will be linked to one or more bars or rigid members.

In the embodiments in which the operators feet directly actuate the motion bar, a cross member may extend perpendicularly and laterally out of each side of the motion bar at the motion bar interface region to provide a support for right and left foot placement. In the embodiments in which the operators hands directly actuate the motion bar, the attached cross member would accommodate the operators right and left hand.

The most practical configuration which allows both upper and lower body exercise is to actuate the motion bar directly with the operators feet, and indirectly with the operators hands. When indirectly actuating the motion bar with the operators hands, one or more rigid members are connected to the motion bar at a joint generally between the motion bar foot interface region and the motion bar trunnion region. These rigid members are to be established such that the range of motion of the indirect hand force receiving member operates within the natural hand motion range of the operator. In what may be the preferred operating mode, the operator is to be seated and will alternatingly push with his/her feet until the foot receiving members are at their furthermost forward position, followed by pushing the hand receiving member in order to return the foot receiving member back toward the operator in preparation for cycle repetition. In all of the embodiments shown, the operator may effect flywheel motion by either pushing or pulling the indirect hand receiving member, but the inventor suggests that in order to reduce back strain as is a common problem on mechanisms such as rowing machines, that the hand receiving member be limited to pushing action.

If it is desired to provide means for the operator to exercise each leg in an alternating manner from right to left, a pair of motion bars may be provided and connected to the flywheel at diametrically opposite positions with respect to the flywheel base joint. In this case, each of the motion bars would have its own foot receiving member or foot platform which may move cyclically out of phase one half of a cycle relative to each other. A hand receiving member may also be connected to each motion bar to provide upper body exercise in an alternating side to side manner.

The hand receiving member may be rotatable about an intermediate joint connected to the machine frame and also jointed at a distal end to a coupler member, with the coupler member jointed at opposite coupler member ends to the motion bar and the hand receiving member. The resulting motion to which the grasped hand would be subjected to is a portion of a circular arc which oscillates back and forth during the cyclic action. As previously indicated, during the preferred action, the operators hand(s) will retract while the operators foot (feet) push forward; and while the operators hand(s) push, the operators foot (feet) will simultaneously retract.

Different configurations are possible with the hand receiving member, for example it may be alternatively connected directly to the motion bar, with a linear bearing in proximity to the hands. With this arrangement, as the motion bar(s) move forward away from the operator, the hand receiving member will move forward also. This action would require the operator to pull the hand receiving member as the feet retract.

In discussing the trunnion region, the reader will recognize that the purpose of the trunnion is to act as a pivot point as the motion bar first joint travels along a circumference defined about the flywheel rotational base joint. The flywheel base joint is fixed to the machine frame and as such will cause the motion bar to be levered back and forth upon leveraging interaction between the trunnion region and motion bar first joint as the flywheel rotates. The trunnion region may consist of a trunnion cam connecting the motion bar trunnion region to the machine frame, or a trunnion joint connecting the motion bar trunnion region to the machine frame. Most of the figures illustrated incorporate a trunnion joint, but the reader will realize a joint is only but one means to accomplish this.

The trunnion joint is established in a number of manners, with the primary intention being to act as a motion bar fulcrum. In the examples illustrated, this results in the trunnion region of the motion bar being primarily constrained in a horizontal, machine longitudinal direction. Because vertical action of the trunnion joint is desired in order to prevent the machine from locking up, the trunnion joint may be connected to a distal end of a rocker bar, with the opposite end of the rocker bar connected to the machine frame. This rocker bar is orientated relatively horizontally in order to establish a reaction force at the trunnion which will prevent the trunnion joint from moving horizontally. The actual motion path to which the trunnion joint will be subjected to when supported by a rocker bar is of course arcuate in form.

In an alternative embodiment, the trunnion element (cam or joint) may simply be constrained within a vertical slot machined into a portion of the machine frame. This will allow the trunnion element to move up and down within the slot, but will prevent the trunnion element from moving horizontally in order to cause the motion bar to oscillate. The exact shape of the output path of the motion bar may also be adjusted by establishing a nonlinear or curved trunnion slot. It should be noted that it is arbitrary as to whether the trunnion element is fixed to the machine frame and operates within a trunnion slot incorporated into the motion bar, or whether the trunnion element is fixed to the motion bar and operates within a trunnion slot incorporated into the machine frame.

Discussing now additional operational characteristics of the machine, the reader will realize that the machine would function with an eccentric bar substituted for the eccentric radius of the above described flywheel. Without a flywheel however, lack of inertial properties during motion bar movement would make operation of this machine difficult. The inertial properties contributed by the flywheel assist the operator during brief ranges of motion within each cycle which are inefficient to actuate.

If an eccentric crank is incorporated in place of the eccentric flywheel radius referred to above, and inertial properties are to be incorporated into the mechanism, the flywheel may be located remote. When establishing a remote flywheel, advantages regarding machine weight distribution and operator visibility may be achieved by locating the flywheel close to the machine base. The drive means provided to the flywheel may be nonsynchronous because the machine designer is only concerned with providing momentum to the motion bars, and drive belt slippage is of no consequence. Typical nonsynchronous drive members would consist of flat or V belts. A remote flywheel is illustrated in one of the figures with a synchronous drive member for considerations primarily due to reduction of noise level during machine operation. It has been the inventors experience that typical drive mechanisms, such as those utilized on bicycle machines and the like, produce significant and unacceptable noise levels during maximum cycle speed, particularly at the extremely high cycle rate during prolonged sessions that the inventor subjects them to.

Continuing now with additional dynamic considerations of this machine, mechanical components such as springs and linear or rotational dampers will now be discussed.

First, in reference to springs, a compression spring may be connected between the motion bar and the machine frame in order to bias the motion bar rearward toward the operator. A spring may also be incorporated on embodiments which do not allow indirect motion bar actuation with the operators hands.

The motion bar may alternatively, or supplementarily, be restricted by a linear damper fixed to the machine frame. Properties of linear dampers include resistance adjustability and damping functionality in one or two directions. Generally, when linear dampers are employed, the primary intention is to add resistance to the motion bar while the motion bar is being pushed by the operators feet.

The flywheel may alternatively or supplementary be dampened by an adjustable rotational damper in order to introduce friction into the system. Such dampers typically consist of a band brake which frictionally engages with the outer circumference of a flywheel, although rotational damping action could also be created with hydraulic means, or the use of electromechanical components when utilizing eddy currents and the like.

Although this invention does not rely upon six bars in all design versions, the reader will note six bars are present in the first embodiment shown in FIG. 1. These bars are the hand receiving member, coupler member, motion bar, rocker bar, flywheel, and the machine frame.

Based upon kinematic analysis, and omitting all input from the operators upper body, accurate values for the motion bar/rocker bar/flywheel configuration shown in the first embodiment during successful machine cycling are as follows: Flywheel weight 20 pounds (89 N), flywheel rotational damper torque 0.07 lb-in-s/degree (0.45 N-m-s/radian), flywheel average rotational velocity 50 rpm (5.2 radian/sec), flywheel eccentric radius 0.61 in (16 mm), distance between trunnion joint axis and motion bar first joint axis 1.80 inches (46 mm) where motion bar first joint is orientated at the six o'clock position with respect to the flywheel rotational axis, foot receiving element input force at 25 pounds (111 N) occurring during one half machine cycle, and approximate foot receiving element displacement 14 inches (0.35 m).

If the operator supplementarily exerts force of 15 pounds (67 N) at the hand receiving member element during the foot receiving element back stroke, the flywheel rotational damper may be increased to 0.11 lb-in-s/degree (0.71 N-m-s/radian) while maintaining the same average flywheel rotational velocity of 50 rpm (5.2 radian/sec). The reader may note that these computations represent a general example, and excludes considerations of one or two way linear dampers, air springs, compression or tension wire form springs, or any other force resisting means which may be installed to act upon any of the moving rigid members.

BRIEF DESCRIPTION OF THE DRAWINGS

The invention will be further described in conjunction with the accompanying drawings, which illustrate preferred embodiments, and wherein.

DETAILED DESCRIPTION OF THE INVENTION

Figure 1:
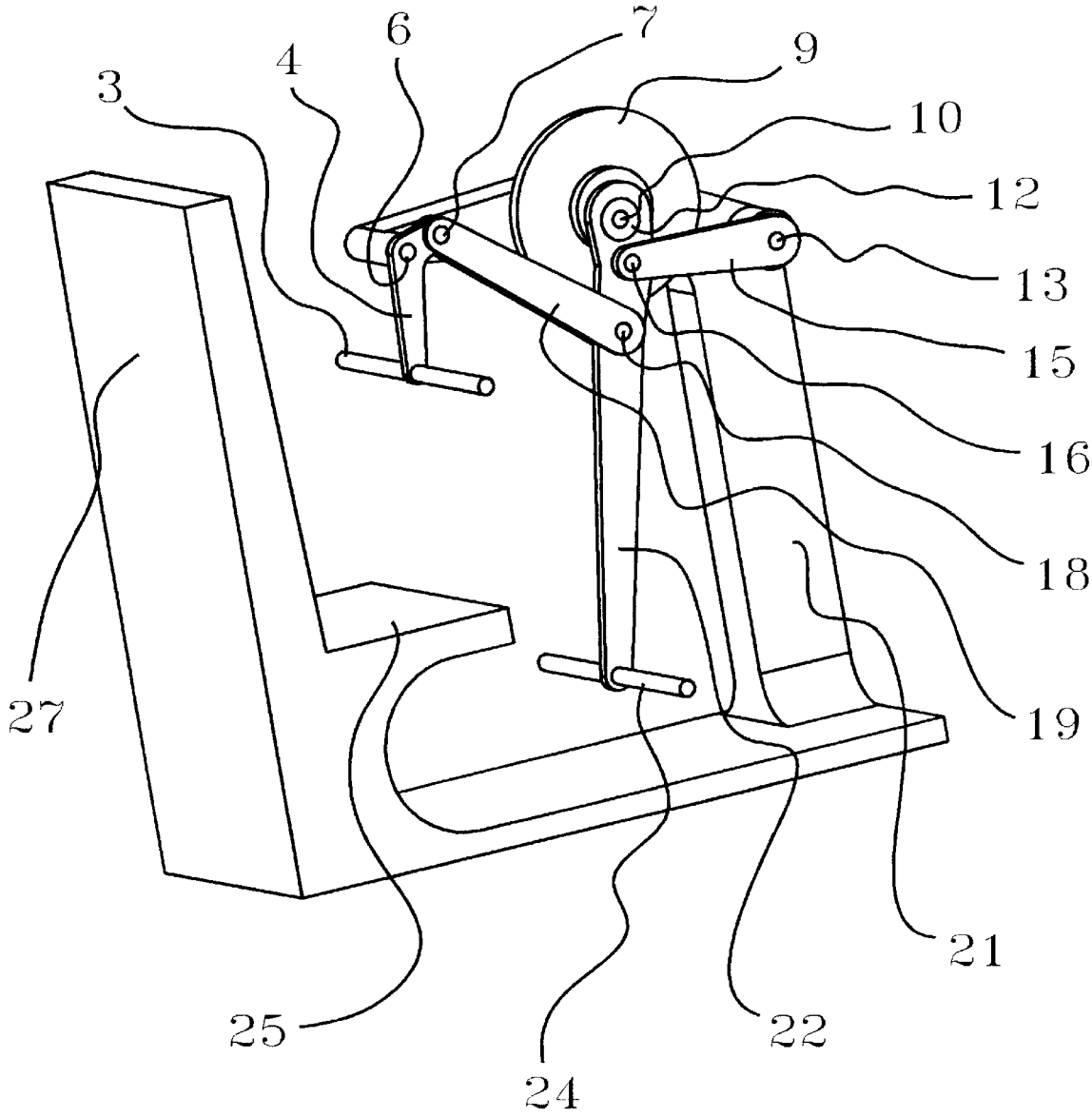
FIG. 1 is a perspective view of a first embodiment which shows a combination upper and lower body exercise machine.

As shown in FIG. 1, a perspective view is shown of the first embodiment. The operator will typically be seated in seat 25 with both feet positioned against foot receiving element 24, and both hands grasping hand receiving member element 3. The operator will operate the machine by alternatingly pushing the foot receiving element 24 and the hand receiving member element 3. The foot receiving element 24 is attached to motion bar 22, and travels about a path of a substantially flat closed curve. The substantially flat closed curve to which the foot receiving element 24 is influenced to travel is defined by motion at the lower distal end of motion bar 22. Inertial characteristics are supplied to the motion bar 22 due to momentum of flywheel 9 rotatably secured at a flywheel base joint to the machine frame 21. The motion bar 22 is rotatably connected at its upper distal end to a flywheel motion bar first joint 10. The flywheel motion bar first joint 10 is not coaxial with the flywheel rotational axis or flywheel base joint, but rather is attached to a flywheel axle eccentric race 12 as to cause the motion bar first joint axis to travel about a circumference as defined by the eccentric flywheel radius about the flywheel rotational axis. The flywheel motion bar first joint is synonymous with the motion bar first joint, and may be considered as a pin with means mounting to allow the members it secures together to rotate relative to one another. This of course applies to all joints discussed in this text.

Continuing with FIG. 1, in relatively close proximity to the motion bar first joint is a motion bar trunnion region. This region of the motion bar 22 must be constrained in one general direction as to cause the lower (opposite) distal end of the motion bar 22 to travel about a relatively flat closed curve. The maximum chordal distance of this closed curve occurs in a direction or an orientation which is parallel to the direction to which the trunnion region of the motion bar is constrained. To constrain the motion bar trunnion region, rocker bar 15 is rotatably secured to machine frame 21 at rocker bar first joint 13, and rotatably connected to the motion bar trunnion region at a trunnion joint or rocker bar second connection 16. During machine operation, the trunnion region of the motion bar is thus constrained to pivot about rocker bar second joint 16, and thus is allowed to move horizontally by no more than the sine of the angle to which the rocker bar oscillates.

Continuing with FIG. 1, a mechanism has been incorporated with this embodiment to allow indirect actuation of the motion bar with the operators hands. Hand receiving member element 3 is secured to hand receiving member 4, and will travel along a portion of a circular arc as hand receiving member 4 pivots back and forth about hand receiving member base joint 6. Coupler member 19 is rotatably secured at a coupler member first joint 7 to the hand receiving member 4, and at a coupler member second joint 18 to motion bar 22.

In further describing the action which the operator would experience when exercising with this machine, the reader will note that this machine will not cause back strain, which is always a problem on those machines in which the operator is required to pull with arms or hands. With this machine, the operator pushes with hands and the user's back is supported at seat back 27. In some respects, this may resemble bench pressing, but the experience is unique because the operator is able to sense the flywheel change in momentum.

Figure 2:
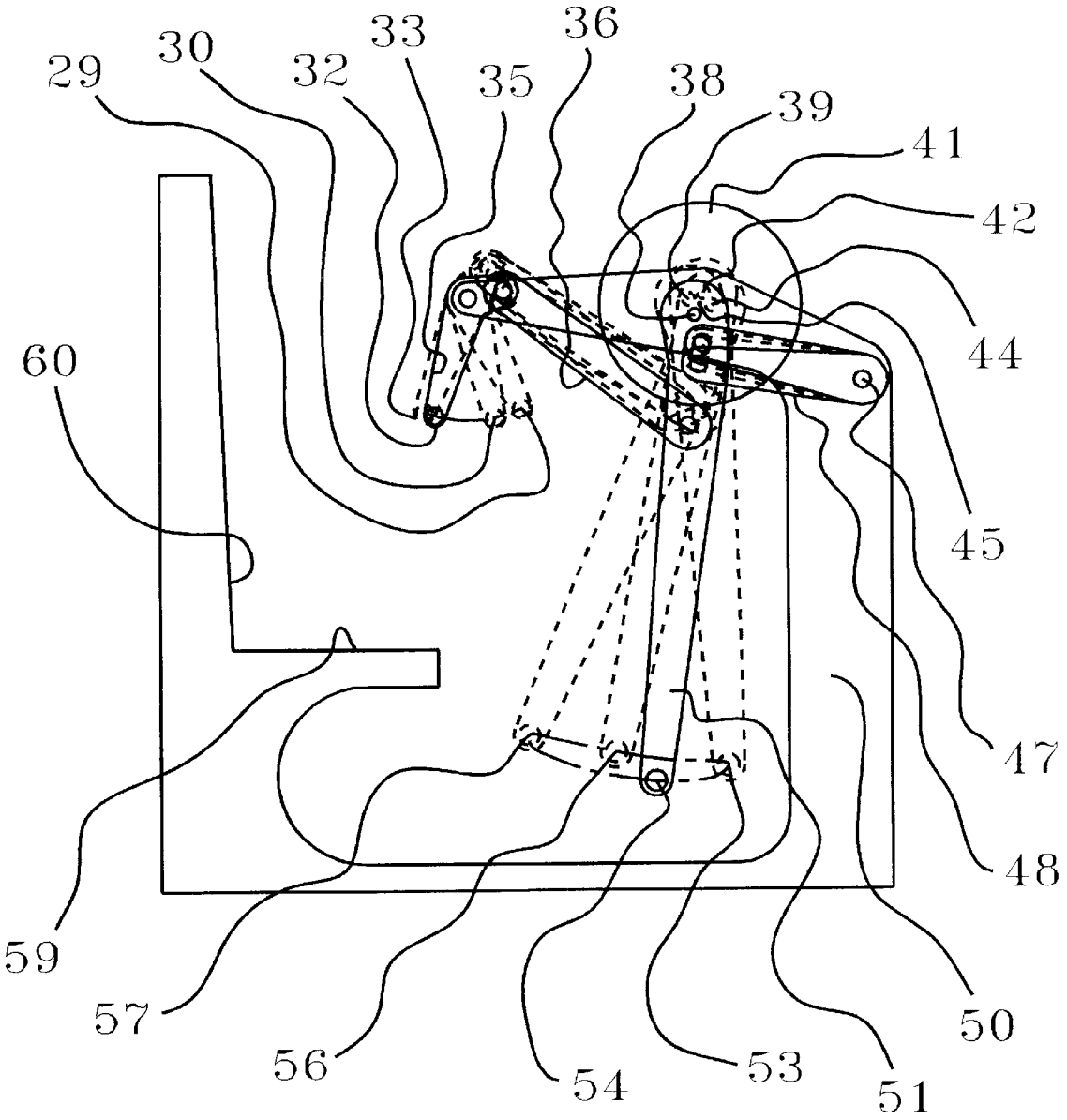
FIG. 2 is a side view of the first embodiment which shows the closed curve motion path and positions of the linkage at four different time increments.

Directing attention now to FIG. 2, a side view is shown of the first embodiment. Flywheel 41 is rotatably secured to the machine frame at flywheel base joint 45. Coupler member 36 is rotatably secured at one distal end to hand receiving member 35, and at an opposite distal end to motion bar 51. Seat back 60 and seat bottom 59 are shown to be secured to machine frame 50. Foot receiving element 54 is attached to motion bar 51, and is shown in solid lines at a first park position with flywheel motion bar first joint 38 at the seven o'clock flywheel position, and with hand receiving member 35 with its attached hand receiving member element 32 shown at a first hand position proximate to the operator. Continuing in a counter clockwise direction along the foot motion path, foot receiving element 53 is shown in dashed lines at a second position with flywheel motion bar first joint 39 at the ten o'clock flywheel position, and with hand receiving member element 33 shown at a second hand position which is directed closer to the operator than the first hand position. It is at this second hand position where the operator is to begin pushing the hand receiving member element.

Continuing counter clockwise along the foot motion path, motion bar receiving element or foot receiving element 56 is shown at a third position with flywheel motion bar first joint 42 at the one o'clock flywheel position, and with hand receiving member element 30 shown at a third hand position directed substantially away from the operator than the second hand position. In the final counter clockwise sequence shown, foot receiving element 57 is shown at a forth position with flywheel motion bar first joint 44 at the four o'clock flywheel position, and with hand receiving member element 29 shown at a forth hand position which is furthest away from the operator. It is at this point that the operator will cease pushing with hand force, and start pushing with foot force, although of course the operator has the option of pushing or pulling the hand and foot receiving members provided the operator is so inclined, and has means to do so. In this respect, the foot receiving element must include a strap or other means to ensure the operator is able to pull with ones feet.

Continuing now, rocker 48 is rotatably secured to machine frame 50 at rocker bar first joint 47, and is shown in four positions corresponding to the four positions cited above of the foot and hand receiving member element. In this embodiment, the total range of oscillation of rocker 48 is approximately seven and one half degrees.

Figure 3:
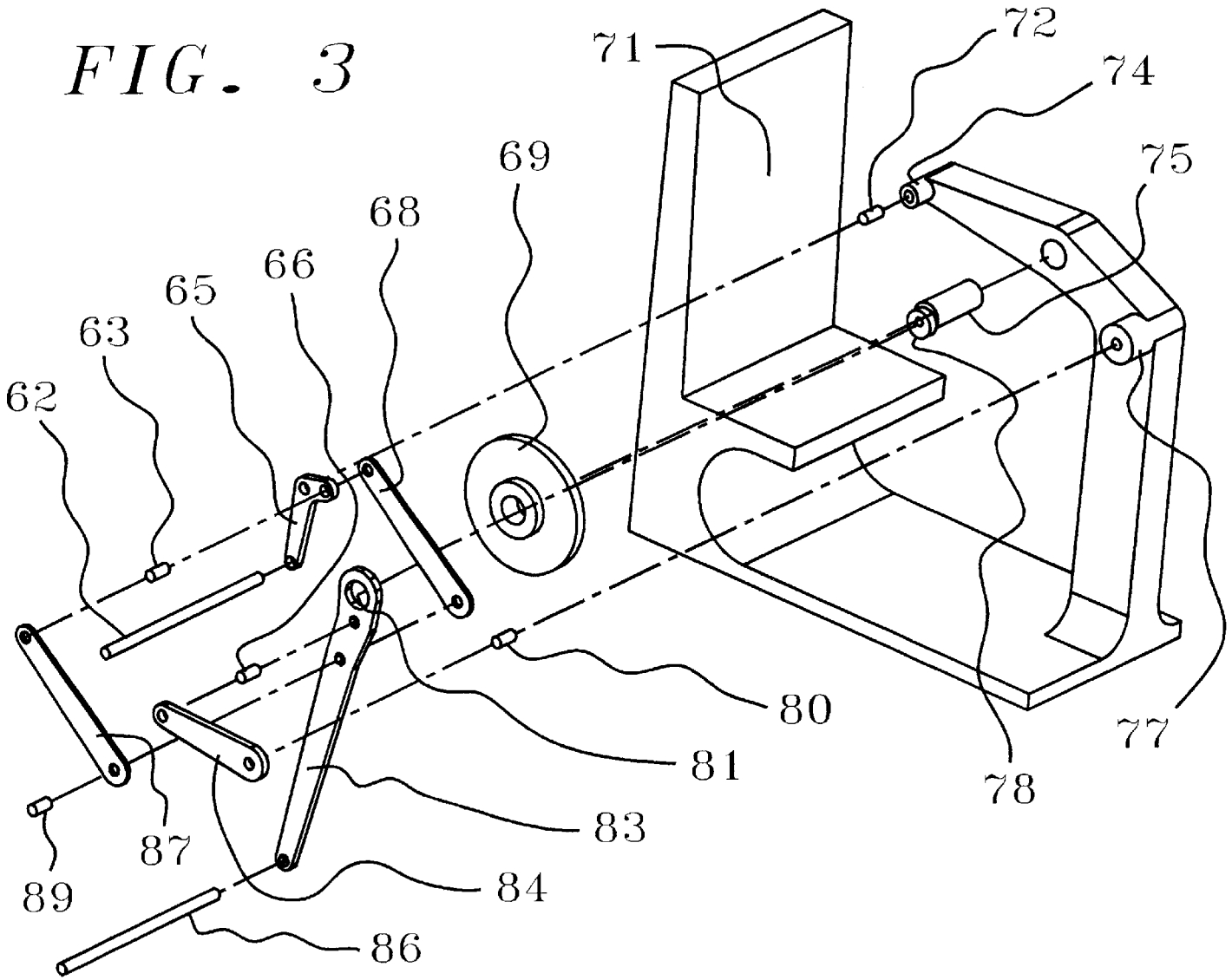
FIG. 3 is an exploded view of the first embodiment.

Directing attention now to FIG. 3, an exploded perspective view is shown of the first embodiment. For simplicity, the seat 71 is shown to be integrated with the machine flame.

Flywheel 69 is secured to flywheel axle 75, where flywheel axle 75 is rotatably secured to the machine frame. This will cause the motion bar 83 to eccentrically travel about the flywheel rotational axis as the flywheel rotates. The motion bar first joint may alternatively be simply directly connected to the flywheel at a flywheel motion bar first joint, but the flywheel eccentric radius in this embodiment is approximately one half of an inch, and to locate two joints of substantial load bearing capabilities in such close proximity to each would necessitate machining an eccentric lobe on the flywheel. The inventor therefore illustrates the flywheel 69 fixedly attached to a flywheel axle 75, said axle containing a flywheel axle eccentric race 78 in order to rotatably secure the motion bar first joint 81.

Continuing now, motion bar 83 is rotatably connected to rocker bar 84 at the motion bar trunnion region by trunnion pin 66, with the opposite distal end of rocker bar 84 rotatably connected to a machine frame rocker joint protrusion 77 by means of rocker frame pin 80. The machine frame rocker joint protrusion 77 is provided simply due to rocker bar transverse placement considerations.

Secured to the lower end of motion bar 83 is foot receiving element 86. In order to provide for indirect hand actuation, right and left coupler members 87 and 68 respectively are rotatably connected at each side of hand receiving member 65 at right and left first coupler member ends by means of hand receiving member coupler pin 63, and to motion bar 83 at right and left second coupler member ends by means of motion bar coupler pin 89. Hand receiving member is rotatably attached to machine frame hand receiving joint protrusion 74 by means of hand receiving member base pin 72. When operating the hand receiving member, the user may push the attached hand receiving member element 62 while the users feet are being retracted, although the linkage/flywheel mechanism will also respond if the user chooses to pull the hand receiving member element 62 while the users feet are pushing the foot receiving element 86.

Figure 4:
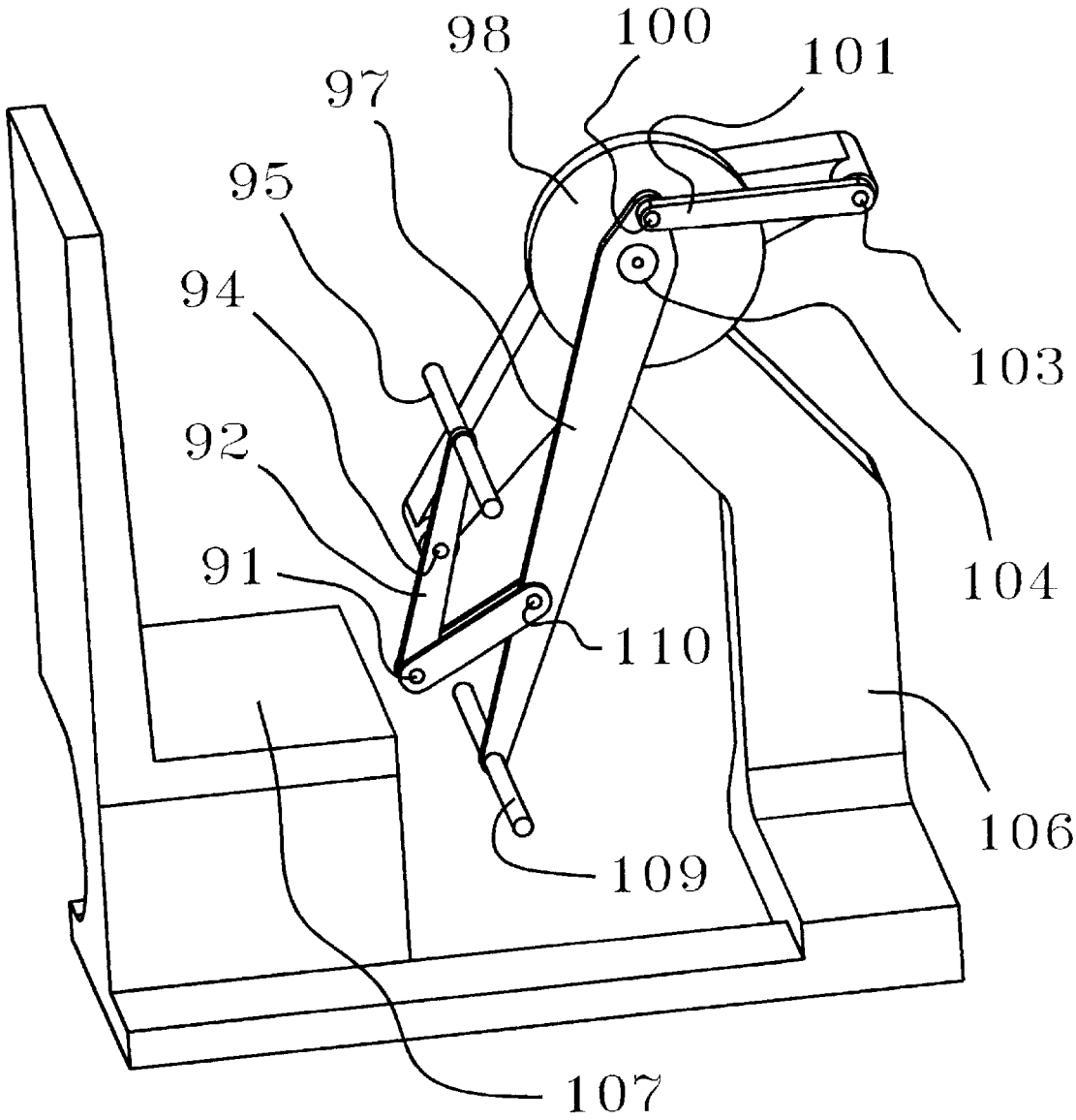
FIG. 4 is a perspective view of a second embodiment of an upper/lower body exercise machine of the present invention.

Referring now to FIG. 4, a perspective view is shown of a second embodiment. In this embodiment, the reader will note that the trunnion region or trunnion joint 100 of the motion bar 97 is not located between the motion bar first joint 104 and the foot receiving element 109, but rather is established proximate to the motion bar first joint at the distal end of the motion bar opposite the foot receiving element.

The exact placement of the trunnion joint effects the shape and orientation of the closed curve, or indeed even if the motion bar will cycle. For example, in the first embodiment the trunnion joint is established at approximately the six o'clock position with respect to the flywheel rotational axis, and in the second embodiment the trunnion joint is established at approximately the twelve o'clock position. Both of these trunnion joint placement positions yield a similar shape and orientation of the closed curve which interfaces with the machine operator, provided that the rocker bar is oriented at an approximate horizontal position as shown. If the rocker bar is jointed to the motion bar in the general manner as shown in the first two embodiments, yet is orientated at a moderate angle from horizontal by moving the trunnion joint toward the flywheel rotational axis (for example by twenty degrees), the motion bar interface region transcribes an arc of reduced radius but at greater displacement such that the motion bar interface region closed curve resembles a crescent Ideally, the motion bar interface region motion path will be fairly linear, and would resemble the arcuate motion paths of the foot or hand receiving elements computed for the present drawings. The reader is therefore informed that the figures presented herein are accurate representations.

Continuing this discussion, if the trunnion region is moved either to a three o'clock or nine o'clock position with respect to the flywheel rotational axis, while maintaining the motion bar generally as shown in these first two embodiments, the horizontal rocker bar will cause the machine to lock up. In the mechanisms which function, the motion bar pivots about the motion bar trunnion region as the flywheel rotates. If the trunnion element is established at the three o'clock (or nine o'clock) position, geometric constaints will not allow the trunnion element translate longitudinally, forward and back with respect to the operator, because the horizontal rocker bar is rotatably secured to the machine frame. The eccentric radius at which the motion bar first joint is rotatably connected will not be allowed to gyrate about the flywheel rotational axis. If the trunnion element is moved to an intermediate clock position (for example the seven or eight o'clock position), again maintaining a horizontal rocker bar, the mechanism may function but would require displacement input at the feet receiving element which is beyond the motion capabilities of the operator.

Continuing now with FIG. 4, machine frame 106 secures operators seat 107, and rotatably secures flywheel 98 base joint, rocker bar 101 base joint 103, and hand receiving member 92 base joint 94. The optional hand receiving member 92 is connected to the motion bar 97 by a coupler member at coupler member first joint 91 and coupler member second joint 110. The hand receiving member element may be a bar orientated horizontally and laterally across the machine, or may have individual handles available for each hand to grasp.

Figure 5:
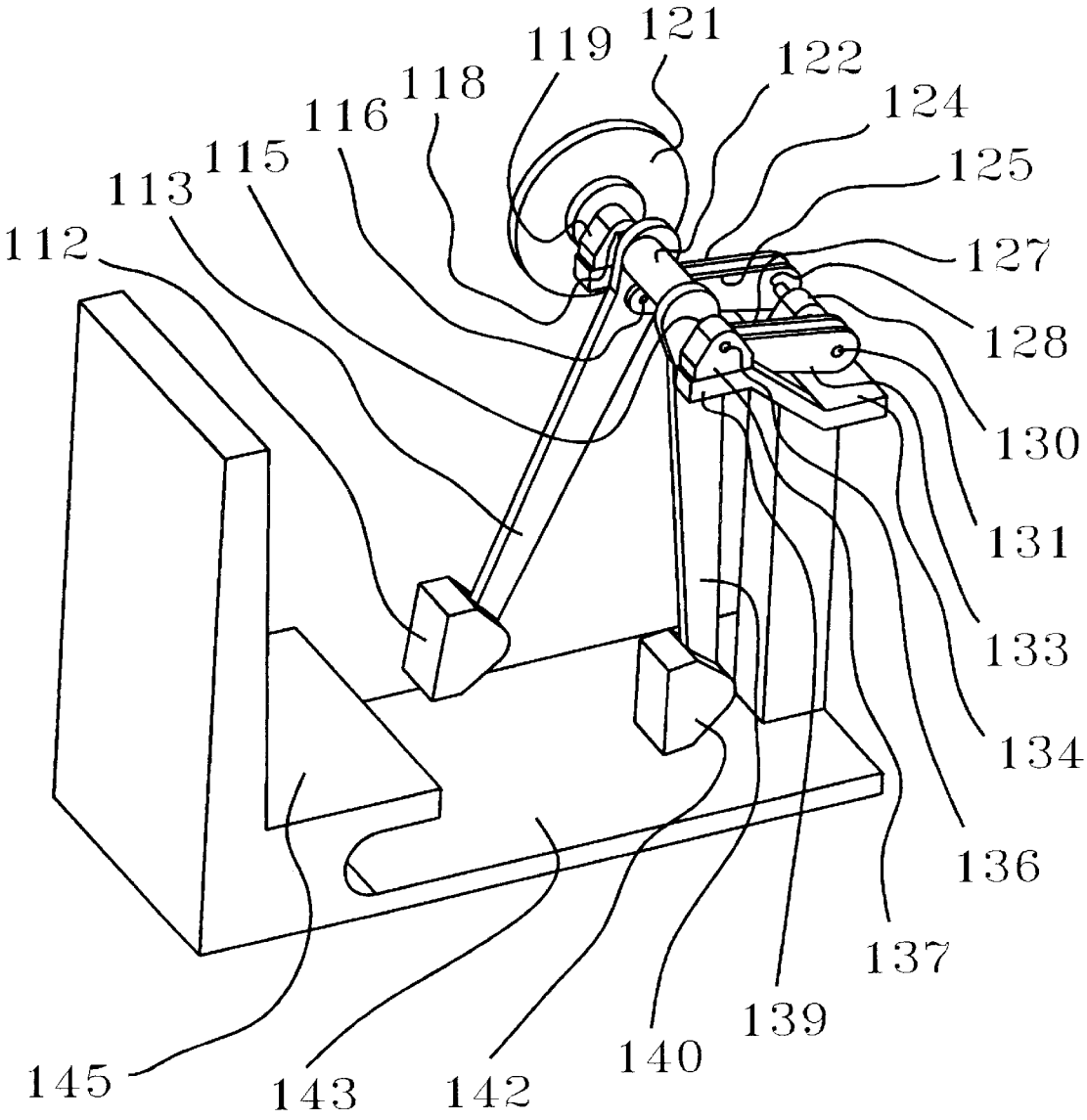
FIG. 5 is a perspective view of third embodiment where two foot platforms are interconnected to one flywheel.

Directing attention now to FIG. 5, a perspective view is shown of a third embodiment intended for lower body exercise only. In this embodiment the motion bar interface region or right and left foot receiving elements are cyclically out of phase with respect to each other by one hundred and eighty degrees such that as the flywheel is rotating, one foot will be pushing, and the other foot will be retracting. Right and left foot receiving elements 142 and 112 may be members which pivot a limited range about the distal ends of right and left motion bars 140 and 113 respectively. Flywheel 121 is keyed to flywheel shaft 118, and is supported at flywheel shaft bearings 119 and 137. Rigid component 122 is also keyed to flywheel shaft 136, resulting in rigid component 122 rotational axis being coaxial with flywheel shaft 136 rotational axis. Motion bar first joint eccentric studs protrude out of both ends of rigid component 122 at diametrically opposite positions. This will establish the one hundred and eighty degree out of phase relationship between the cycling foot receiving elements. The right motion bar first joint 115 is partially visible in this figure. Inner and outer left rocker plates 125 and 124 respectively are rotatably secured at one end to the left motion bar trunnion region by means of trunnion joint 116, and at an opposite forward end at a rocker base shaft 131. Inner and outer right rocker plates 127 and 133 respectively are rotatably secured at a rearward end to the right motion bar trunnion region, and at an opposite end to rocker base shaft 131. Rocker base shaft 131 is supported at the machine frame at shaft block 130. Shaft block 130 may be fixedly attached to the rocker shaft 128 or 131 because both the right and left rocker plates will be rocking back and forth toward mutually opposite directions during machine operation, and will consequently be provided with independent bearing and supporting means. Machine frame 143 is shown to fixedly secure seat 145 and frame extensions 134 and 139.

Figure 6:
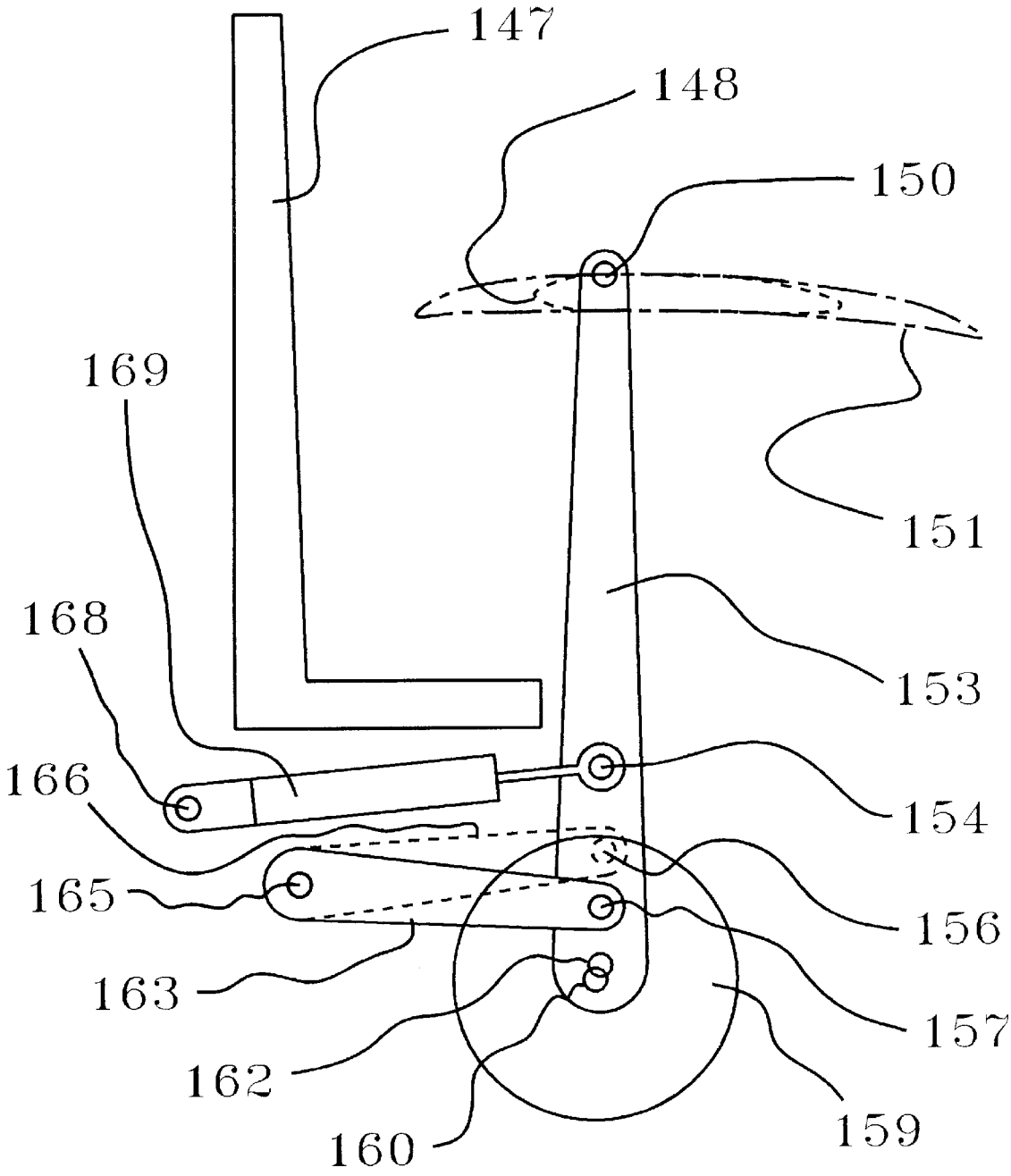
FIG. 6 is a side view of a forth embodiment for upper body exercise, and shows the effect upon the closed curve motion path when the rocker bar is provided with an adjustable rocker bar to motion bar pin joint location.

Referring now to FIG. 6, I have illustrated a side view of a fourth embodiment. In this embodiment, the mechanism is used only for upper body exercise, as foot receiving elements are not provided. Operator will be seated in seat 147 with hands gripping hand receiving member element 150. The operators hands will travel in one direction along the closed curve motion bar path 151 in a cyclical manner, while flywheel 159, rotatably secured to machine frame at flywheel base joint 160, will rotate in the opposite direction. Motion bar 153 is rotatably secured to an eccentric flywheel motion bar first joint 162 as to cause the motion bar first joint to circumferentially travel about the flywheel base joint 160. The eccentric radius is equal to the distance between the axes of the two flywheel joints. Rocker bar 163 is rotatably secured to the machine frame at rocker bar first joint 165, and will permit the trunnion joint 157 to move up and down by the approximate distance of twice the eccentric flywheel radius. The rocker bar will also limit the trunnion joint from moving in the machine longitudinal direction by an amount equal to the cosine of one half of the angle to which the rocker bar pivots.

Continuing with FIG. 6, optionally installed on this mechanism is a linear damper 169 or hydraulic shock absorber. This damper is not critical to operation of the machine, but may allow the user to better define force parameters. The damper 169 is rotatably secured to the machine frome at damper base joint 168, and it its opposite end joint 154 to most any region of the motion bar or rocker bar. The damper may furthermore incorporate an adjustable orifice, and/or be designed to develop resistance in one direction only.

This side view also illustrates a means to adjust the machine such that the hand receiving member element displacement distance may be reduced. Rocker bar 163 is shown is solid lines, but if alternate rocker bar 166, shown in dashed lines, is secured to the motion bar at alternate trunnion joint position 156, than an alternate hand receiving member element motion path 148, shown in dashed lines, will result in less travel or reduced hand displacement. This reduction in the motion bar interface region closed curve major axis could be advantageous for users with relatively short arms. It may be noted that the inventors earlier reference of a crescent form of output motion path refers to an output motion path that would be generated if the rocker is pivoted such that the trunnion joint is brought in closer proximity to the flywheel rotational axis.

Brief additional discussion regarding the force receiving member motion path is perhaps in order. In reference to the first embodiment, if the operator chooses to actuate the motion bar such that the motion bar receiving element travels counter clockwise along its closed curve motion path, then the flywheel will be caused to travel in a clockwise direction. This relationship is opposite the directional characteristics of the second embodiment in which if the operator actuates the motion bar receiving element counter clockwise along the closed curve motion path, then in this case the flywheel will be caused to rotate counter clockwise. The correlation, or non correlation in this respect is dependent upon whether the trunnion region is located between the flywheel rotational axis and the foot receiving element as in the first embodiment, or if the flywheel rotational axis is located at some point generally between the trunnion region and the foot receiving element. All embodiments of this invention follow this criteria.

Figure 7:
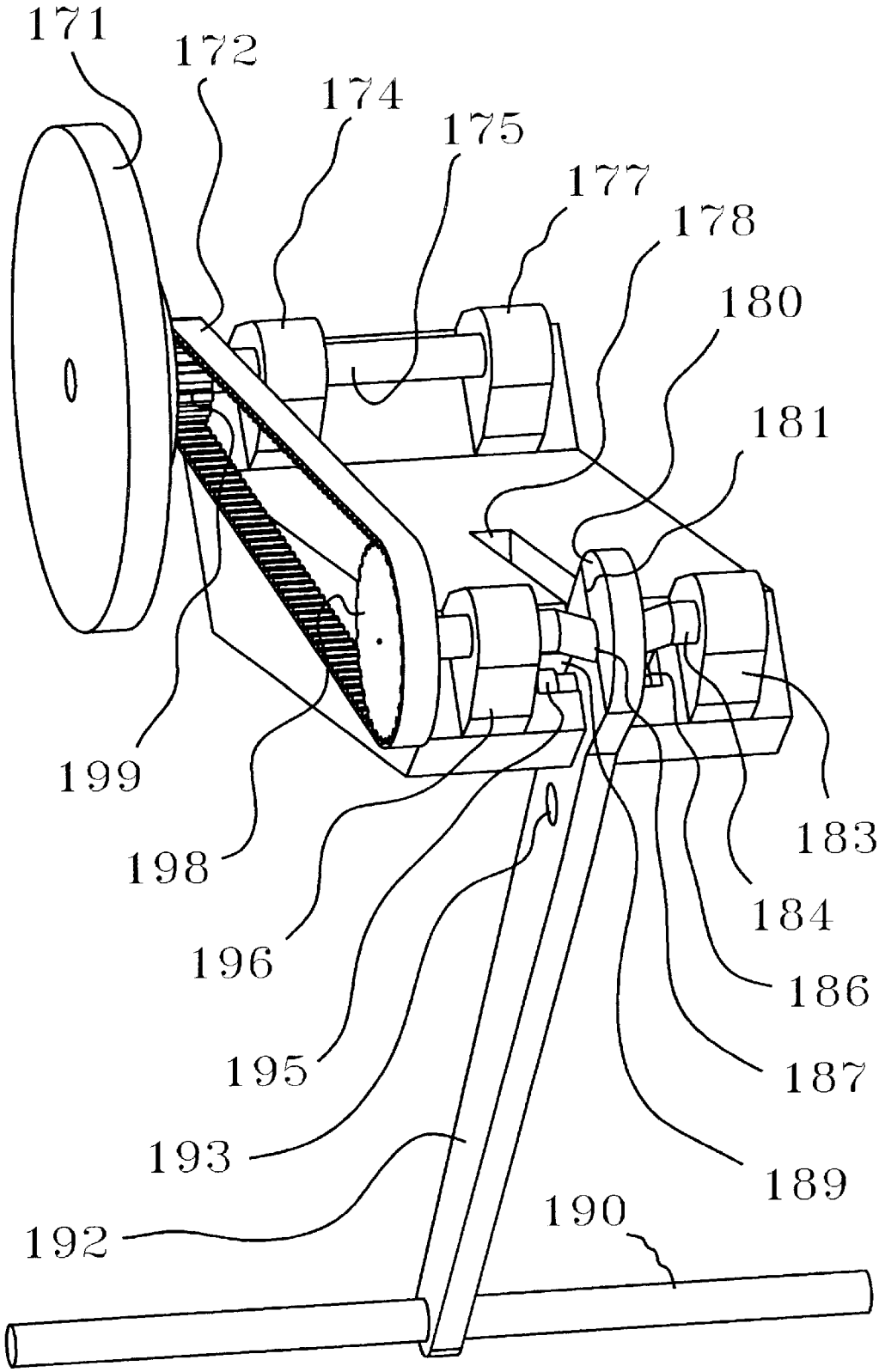
FIG. 7 is a perspective view of fifth embodiment for lower body exercise, where the trunnion joint is constrained to slide vertically.

Directing attention now to FIG. 7, a perspective views of a fifth embodiment is illustrated. This embodiment incorporates a remote flywheel 171 rotatably connected to a motion bar crank 184. Motion bar 192 supports a foot receiving element 190, and also has an available auxiliary joint 193 in the event an indirect hand receiving member is to be installed. The motion bar crank 184 is rotatably supported at first and second crank bearings 183 and 196 respectively, and has an eccentric crank journal 187 rotatably connected to the motion bar first joint. The motion bar first joint may be split at motion bar first joint end cap 180 which separates at motion bar first joint parting surface 181. This is only one of several means enable the mechanism to be assembled. Clearance to allow the motion bar to cycle is provided at machine frame slot 178.

Motion bar sprocket 198 is provided at one end of the motion bar crank 184, and will drive or be driven will an endless member 172 operating in combination with a flywheel sprocket 199. The flywheel sprocket 199 is connected to the flywheel and to a flywheel shaft 175, where said shaft is supported by first and second flywheel shaft bearings 177 and 174. This endless member may typically be a roller chain, V-belt, flat belt, synchronous belt, or even round belt. As noted earlier, synchronization is not necessary as the endless member 172 simply provides momentum transfer to and from the flywheel.

The trunnion element 195 and 186 in this embodiment is fixed to the motion bar 192 at a motion bar trunnion region, and is slidably contained within a trunnion groove 189 machined into the machine frame at each side of the motion bar. Although, as indicated earlier, an opposite trunnion groove arrangement may be configured. The trunnion element may have a circular cross section or a noncircular cross section. A noncircular trunnion element or trunnion cam will enable the machine designer to further modify the shape of the closed curve motion path of the motion bar force receiving element. In this case, the location of the trunnion region axis may be designed to follow a predetermined trunnion region axis closed curve path due to the trunnion region camming action as the machine is cycled. The trunnion cam would experience a combination of rolling and sliding.

Figure 8:
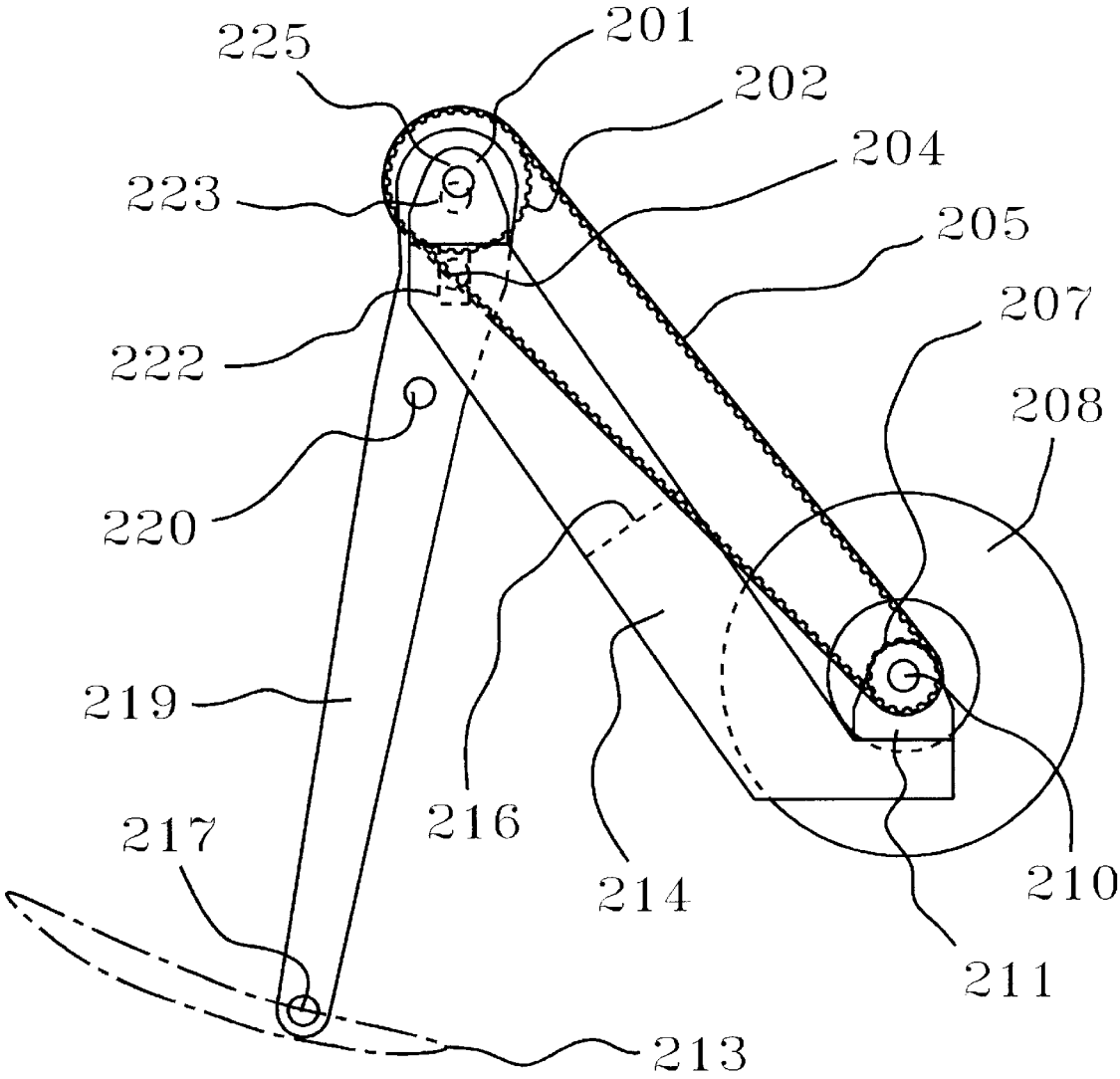
FIG. 8 is a side view of the fifth embodiment.

Referring finally to FIG. 8, a side view is shown of the fifth embodiment. Foot receiving element 217, secured to motion bar 219, will travel along foot receiving element motion path 213 in a path direction mutually opposite the direction to which the flywheel 208 will be caused to rotate. Motion bar first joint 223 will eccentrically travel about motion bar crank 225 as the operators feet cycle the mechanism. Motion bar crank 225 is rotatably supported at motion bar crank bearing 201. Motion bar clearance slot end 216 is machined into machine frame 214 in order to accommodate the centrally located motion bar 219. Trunnion element 204 is fixed to the motion bar trunnion region, and slidably contained within machine frame trunnion groove 222. Motion bar 219 will be caused to pivot about trunnion joint 204 as the motion bar first joint 223 (or eccentric crank journal) is cycled about the motion bar crank 225. The trunnion joint 204 will reciprocate up and down within the machine frame trunnion groove 222 by a distance equal to twice the eccentric radius.

In order to rotatably connect remote flywheel 208 to motion bar crank 225, crank sprocket 202 is rotatably connected to flywheel sprocket 207 by endless drive member 205. Flywheel shaft 210 is rotatably secured at flywheel shaft bearing 211, wherein said bearing is affixed to machine frame 214. Motion bar auxiliary joint 220 is provided for direct or indirect actuation by the operators hands. Direct actuation in this case would be if the operator simply pushed and pulled at the auxiliary joint, and indirect actuation would require a coupler member and a hand receiving member element as described earlier in this text.

In this embodiment, as well as all of the embodiments specifically described, additional elements such as mechanical springs, constant force pressure actuated rod end cylinders, linear dampers (dampening in one or two directions), or rotational dampers may be employed as desired to add different characteristics of motion resistance when directly installed to act upon the motion bar, coupler member, hand receiving member, hand receiving member element, foot receiving element, rocker bar, crank axle, flywheel, or any other member of the mechanical system. Also, a wide range of linear or rotary actuators, servo motors, electric clutches, programmable hardware, and other mechanical or electromechanical devices may be incorporated upon the mechanism to improve the physical interface between the operator and the machine, should such enhancements be sought. Such enhancements could also entail establishing spring constants and/or damper values which are a function of flywheel rotational speed, where upon startup the spring constant and/or damper value is very low, and upon steady state operation the spring constant and/or damper value has been maximized.

Thus, an improved exercise mechanism is shown which provides the operator with motion and force characteristics new in the art. While preferred embodiments of the invention have been shown and described, it will be apparent to those skilled in the art that changes and modifications can be made in these embodiments without departing from the principles and spirit of the invention, the scope of which is defined in the appended claims.

I claim:

1. An elliptical motion exercise apparatus, comprising:

a frame designed to rest upon a floor surface;

a crank member mounted on said frame and rotatable about an axis relative to said frame;

a force receiving member having a first portion configured for engagement by a person, and a second portion rotatably connected to said crank member at a point radially displaced from said axis;

a guide member connected to said frame and operative to direct a third portion of said force receiving member through a reciprocal path as said crank member rotates, wherein said first portion of said force receiving member is directed through a generally elliptical path as said crank member rotates; and a variable length member interconnected between said frame and one of said force receiving member and said guide member, wherein said variable length member resists movement of said guide member relative to said frame.

2. The exercise apparatus of claim 1, wherein said guide member pivotally mounted on said frame.

3. The exercise apparatus of claim 2, wherein said generally elliptical path is selectively adjusted by pivoting said guide member to a different orientation relative to said frame.

4. The exercise apparatus of claim 3, wherein said variable length member includes a cylinder and a rod that are interconnected in telescoping fashion.

5. The exercise apparatus of claim 1, wherein said generally elliptical path is selectively adjusted by relocating a point of interconnection between said guide member and said force receiving member.

6. The exercise apparatus of claim 1, wherein said variable length member includes a cylinder and a rod that are interconnected in telescoping fashion.

7. The exercise apparatus of claim 1, wherein said variable length member is a linear damper.

8. The exercise apparatus of claim 1, wherein said variable length member is pivotally interconnected between said frame and said force receiving member.

9. The exercise apparatus of claim 1, wherein said first portion is proximate a distal end of said force receiving member.

10. The exercise apparatus of claim 9, wherein said second portion is proximate an opposite distal end of said force receiving member.

11. The exercise apparatus of claim 10, wherein said guide member is a rocker link that is pivotally interconnected between said frame and said force receiving member.

12. The exercise apparatus of claim 9, wherein said guide member is a rocker link that is pivotally interconnected between said frame and said force receiving member.

13. The exercise apparatus of claim 1, wherein said guide member is a rocker link that is pivotally interconnected between said frame and said force receiving member.

14. The exercise apparatus of claim 13, wherein said first portion is a hand receiving member that is sized and configured for grasping by the person.

15. The exercise apparatus of claim 12, wherein said first portion is a hand receiving member that is sized and configured for grasping by the person.

16. The exercise apparatus of claim 11, wherein said first portion is a hand receiving member that is sized and configured for grasping by the person.

17. The exercise apparatus of claim 10, wherein said first portion is a hand receiving member that is sized and configured for grasping by the person.

18. The exercise apparatus of claim 9, wherein said first portion is a hand receiving member that is sized and configured for grasping by the person.

19. The exercise apparatus of claim 1, wherein said first portion is a hand receiving member that is sized and configured for grasping by the person.

20. The exercise apparatus of claim 1, further comprising a seat mounted on the frame.

* * * * *